United States Patent [19]

Frei

[11] 4,117,884

[45] Oct. 3, 1978

[54] TUBULAR HEAT EXCHANGER AND PROCESS FOR ITS MANUFACTURE

[75] Inventor: Willi Frei, St. Gall, Switzerland

[73] Assignee: Air Fröhlich AG für Energie-Rückgewinnung, Teufen, Switzerland

[21] Appl. No.: 668,527

[22] Filed: Mar. 19, 1976

[30] Foreign Application Priority Data

Mar. 21, 1975 [CH] Switzerland ..... 1390/75
Feb. 5, 1976 [CH] Switzerland ..... 361/75

[51] Int. Cl.[2] ..... F28D 1/04; F28F 9/04

[52] U.S. Cl. ..... 165/175; 29/157.4; 165/79; 165/178

[58] Field of Search ..... 165/79, 173, 175, 172, 165/178; 29/157.4

[56] References Cited

U.S. PATENT DOCUMENTS

| | | | |
|---|---|---|---|
| 1,544,692 | 7/1925 | Sonneborn | 165/175 |
| 2,240,537 | 5/1941 | Young | 165/175 X |
| 3,186,924 | 6/1965 | Williamson | 165/79 X |
| 3,311,164 | 3/1967 | Cox et al. | 165/158 X |
| 3,422,884 | 1/1969 | Otten | 165/79 X |
| 3,581,814 | 6/1971 | Jackson | 165/175 X |
| 3,627,039 | 12/1971 | Tiefenbacker | 165/175 X |
| 3,633,660 | 1/1972 | Young | 165/173 X |
| 3,739,840 | 6/1973 | Jones | 165/175 X |
| 3,993,126 | 11/1976 | Taylor | 165/173 |
| 4,030,540 | 6/1977 | Roma | 165/172 |

FOREIGN PATENT DOCUMENTS

| | | | |
|---|---|---|---|
| 2,250,087 | 11/1973 | France | 165/173 |
| 731,431 | 6/1955 | United Kingdom | 165/173 |
| 724,258 | 2/1955 | United Kingdom | 165/175 |
| 724,017 | 2/1955 | United Kingdom | 165/173 |
| 510,810 | 8/1939 | United Kingdom | 165/175 |

*Primary Examiner*—Charles J. Myhre
*Assistant Examiner*—Sheldon Richter
*Attorney, Agent, or Firm*—Birch, Stewart, Kolasch and Birch

[57] ABSTRACT

A tubular heat-exchange unit and method for its manufacture comprising a plurality of heat-exchange tubes disposed in the vertical and horizontal direction in a stacked, spaced-apart relationship, the end portions of said tubes being adheringly embedded at both ends thereof in a wall of a hardened, elastic material, said wall at both ends of said tubes separating an inner zone defined by the space around said tubes from the end zones which communicate with the space within said tubes.

7 Claims, 10 Drawing Figures

TUBULAR HEAT EXCHANGER AND PROCESS FOR ITS MANUFACTURE

BACKGROUND AND SUMMARY OF THE INVENTION

The present invention relates to a tubular heat exchanger and to a process for its manufacture.

It is known, in the recovery of energy from a medium, say a gaseous one like an exhaust gas, to make use of another medium, for example fresh air, and also to utilize tubular heat exchangers comprising a plurality of parallel tubes made from industrial silicates, for instance glass. The tubes form the flow path for one of the media, while the flow path for the other medium is formed by the gaps between the tubes.

Known heat exchangers of this kind comprise a metal housing with two opposite metal plates with bores for inserting the tubes. The tubes are held in said bores by elastic sealing sleeves ensuring that the tubes are both tightly and elastically mounted to said plates. The use of the seals and the tubes requires a complex manufacturing process. Since force is required to insert the tubes, once the seals have been mounted to the plate bores, there is an appreciable danger of breakage. Also, the tightness of every individual plate bore is not ensured.

An object of the present invention is to provide an improved tubular heat exchanger and a method for its manufacture.

Another object of the present invention is to provide a tubular heat exchanger wherein the end portions of the heat exchanger tubes making up the heat exchange are elastically sealed together, thereby providing a tight elastic support for the tubes.

A further object of the present invention is to provide a tubular heat exchanger which places little stress on the ordinarily thin-walled tubes.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention proposes a heat exchanger which not only eliminates the complex insertion of the tubes into narrow plate bores provided with sealing sleeves, but also provides, by simple manufacturing steps, the flawless, tight and elastic support for the tubes. The tubular heat exchanger of the present invention achieves this end by providing two opposite and spaced-apart metal beams, each adhering to a wall of a hardened, elastic plastic, the end portions of said tubes being firmly and adheringly embedded in said hardener. The tubes are made of an industrial silicate.

The hardened, elastic, plastic material, for instance silicone-rubber, is used not only because of its flawless surface adhesion for sealing the tube passages, but also because of its elasticity which provides a firm, yet yielding support for the tubes so that they are protected against breakage from impact or vibration when moving and assembling the heat exchanger and when the heat exchanger is in operation.

The process for manufacturing the heat exchanger according to the present invention is characterized in that in the region of the end portions of the tubes which are spaced substantially parallel to one another and temporarily supported, a wall made by casting plastic is built up for enclosing the tube ends, whereupon the material hardens but remains elastic.

The building of the walls may take place vertically by alternating the deposition of the viscous material and a layer of tubes in an upright frame, or horizontally by pouring the elastic hardening material around the tubes supported by a base in a reclining frame. A process which was found to be especially advantageous mounts and dimensions the holes corresponding to the tubes in a foil or the plate disposed in the frame. The foil or plate may be made of plastic or metal sheet and said holes extending into a standing tube bundle are temporarily fixed with respect to the same, whereupon the frame is cast or "potted" with liquid plastic. The liquid plastic penetrates into the gaps between the tubes and the bore in the plate or foil by capillary action. It was found that this necessarily leads to centering of the tubes in the plate or foil holes. This ensures that the plastic surrounds the tube near the plate or foil very evenly, that is, with nearly a constant layer thickness, so that upon hardening of the plastic, each tube is elastically held on all sides. Building up the wall from a liquid plastic not only is relatively easy to carry out, but in addition, provides an absolutely tight joint between the tube and the wall and flawless support of the tube at the wall.

If the process is to be carried out for horizontally disposed tubes, that is, by a layerwise build-up of the tubes, then two horizontal, parallel bars are coated with a layer of viscous adhesive which is capable of hardening into an elastic seal, and a first layer of tubes disposed in a spaced-apart relationship are pressed by their ends into the adhesive layers. Additional adhesive layers are then deposited over the first layer of tubes and each layer of tubes is, in turn, pressed into the adhesive layers. Bars which are identical to the lower ones are pressed into the adhesive strips of the top layer, thus covering the last layer of tubes. The adhesive strips from each side of the tubes connect with each other to form a wall which, upon hardening, adhere tightly and elastically to the bars and to the tubes. The heat exchanger units thus comprise a pair of walls, each lying between a pair of bars with the tubes tightly adhering therein being inserted into the inlets and outlets of the flow paths of the housing for the two media.

As already mentioned, the casting method has been found to be especially advantageous. It allows for making heat exchangers wherein the supporting tube walls are made from an elastic plastic and do not require a rigid insert plate or foil. Thus, this method allows for placing the tubes between a lower and an upper template, sealing the tube ends with respect to the outside and determining the tube separations, one mounting frame being mounted to each template, whereupon after rotating the unit by 180°, the other pan traversed by tubes and bounded by the template and mounting frame is potted with an adhesive hardening into an elastic solid, whereupon the templates are removed. Silicone rubber again may be used in this case as the adhesive. If the heat exchanger is intended to be subjected to large requirements regarding pressure and temperature differences, for example for heat exchanges utilizing liquids, a rubber similar to natural rubber, e.g., butadiene-styrene, and subjected to a vulcanizing process will be appropriately used as the adhesive.

For relatively large tube separations, a template again may be positioned prior to potting into the potting dish, the bores allowing for radial play when the tubes are inserted. Only the interstices remaining between the tubes and the template require potting. The template then may itself serve as the frame or it may be potted together with one.

It was found in many cases that the chemical resistance of the adhesive will sometimes be insufficient. Therefore, it was found to be particularly appropriate to cover that side of the wall formed by the adhesive and which is particularly exposed to the reactive media with a protective foil, for example, Teflon. A hole-bearing protective foil corresponding to the array of tubes is deposited on the bottom of the template-part forming the potting dish. This protective foil remains as a lost sheathing in the finished exchanger structure and covers the particular sidewall of the adhesive and protects it from the contacting medium.

It was found for heat exchangers with relatively long tubes that vibrations may occur especially in operating with gaseous media of high flow rates, and thus tube breakage may result. In such cases, it may therefore be necessary to additionally support the tubes between their two support walls so as to prevent the undesirable, strong vibrations. This additional support may be secured by interposing rods between adjacent tube layers or by providing intermediate template-like support foils or walls which are traversed by the tubes. Such support walls may basically be of the same design as the lateral support walls. In such a case the intermediate walls enclosing and tightly adhering to the silicate tubes divide the flow channel between the tubes into a corresponding number of sections.

Not only are all of the manufacturing processes of the present invention easy to carry out, but also they necessarily lead in the same operational sequence to tightly, elastically and yieldingly fix the tubes into the wall formed from the adhesive.

Since it is immediately possible to equip the heat exchanger with two, four or more such units all equal to one another, the individual heat exchanger made up of the same units can, despite mass production, meet or be adapted to meet practically all existing requirements regarding size or output.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
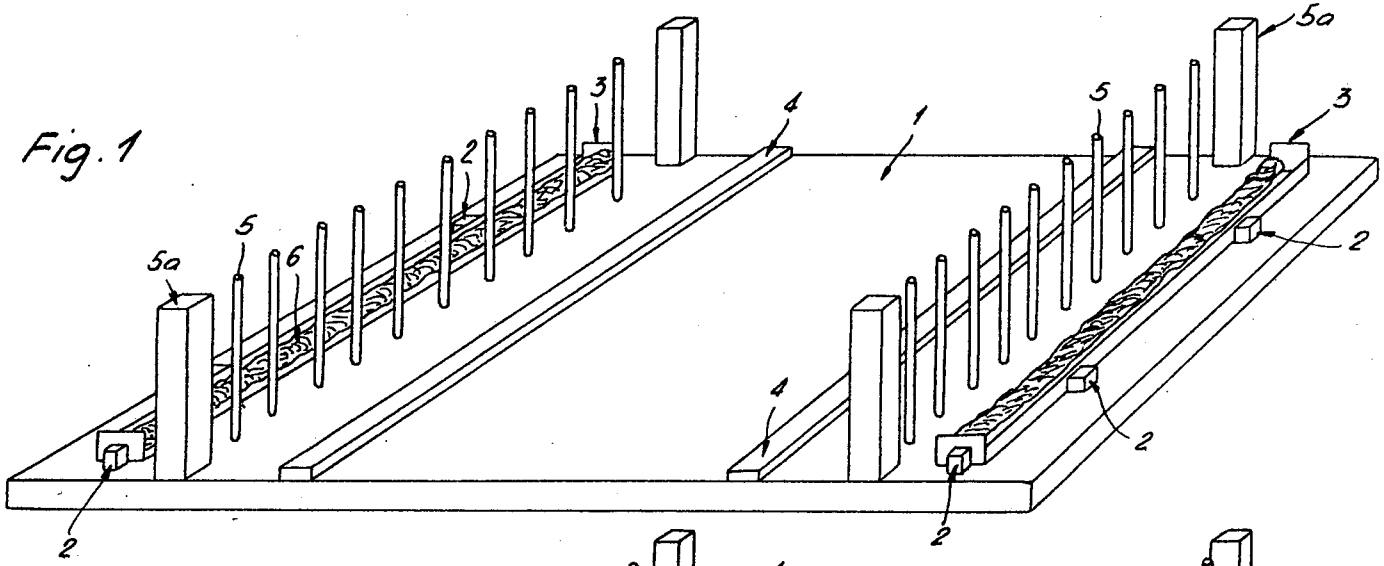
FIGS. 1–3 are diagrams of each phase of a first embodiment of the process for making a tube nest.
Figure 2:
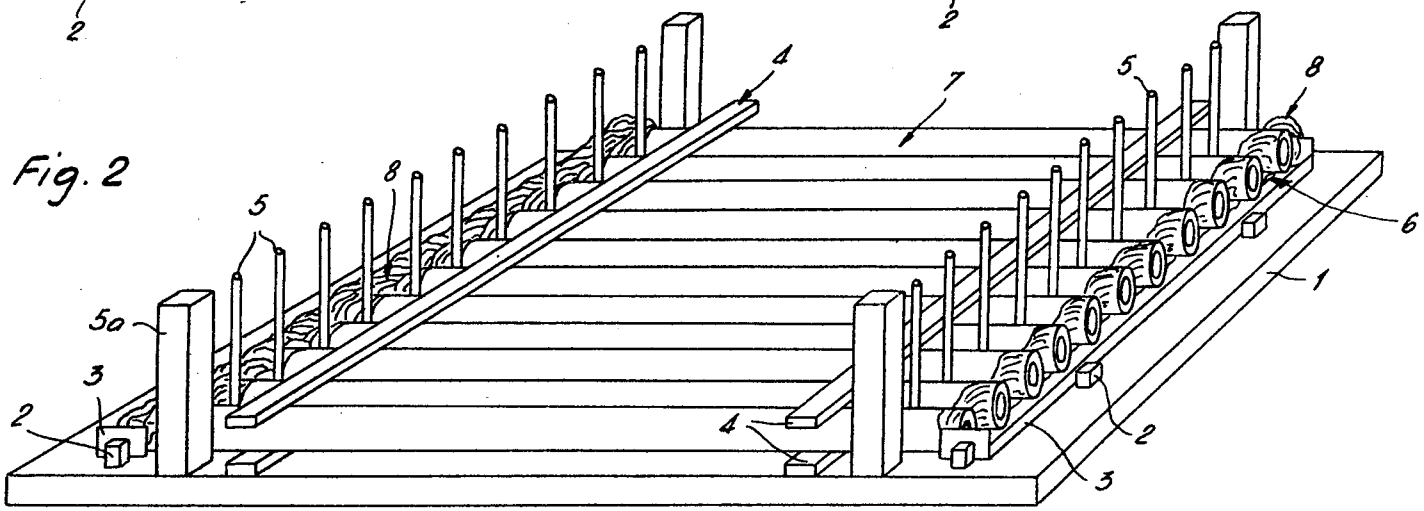
Figure 3:
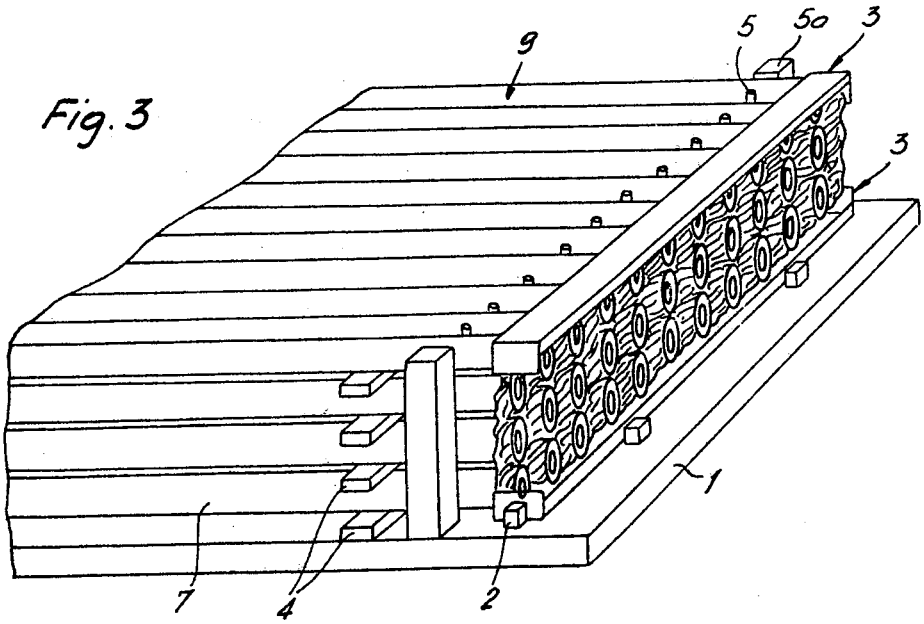

As shown by FIGS. 1–3, the manufacturing of the tubular heat exchanger of the present invention is as follows: Fixing blocks 2 are mounted on a base plate 1, said blocks securing two parallel metal bars 3 on plate 1, said bars being disposed parallel to each other and spaced apart, in their relative positions. Spacers 5 corresponding to the desired horizontal spacing between the tubes are placed in two rows between the two profile bars 3 on plate 1, each row with one terminal limit element 5*a*. Two horizontal distance bars 4 correspond to the desired (approximately the same) vertical tube separation. A layer 6 of viscous material with adhesive properties is deposited on each of shaped bars 3. The viscous material, which advantageously may be a plastic material, possesses the property of hardening into a rubber-elastic body after being exposed to air and adheres in an airtight manner to the element it touches. Immediately after depositing these two layers 6, that is, while they are still in the viscous state, a first layer of exchanger tubes 7 is placed between spacer elements 5, 5*a*, and the tubes are pressed into material layer 6 until the sides of the tubes touch the distance bars 4. After placing another pair of distance bars 4 on the first layer of exchange tubes, a further material layer 8 (FIG. 2) is deposited on the tube ends and on the material layer in-between, and a second layer of tubes 9 is placed on said first layer and pressed into the plastic material. This procedure is repeated until the desired number of tube layers is obtained. Two top profile bars 3 which are in alignment with the lower profile bars are pressed on the last layer of material deposited on the top layer of tubes (FIG. 3). Thus, a cohesive structure of shaped bars 3, adhesive material 6, 8, and tubes is formed on the base plate 1, which, after hardening of material 6, 8, and upon the removal of the distance bars 4, may be lifted off the base plate 1 as a finished heat exchanger unit 11.

Figure 4:
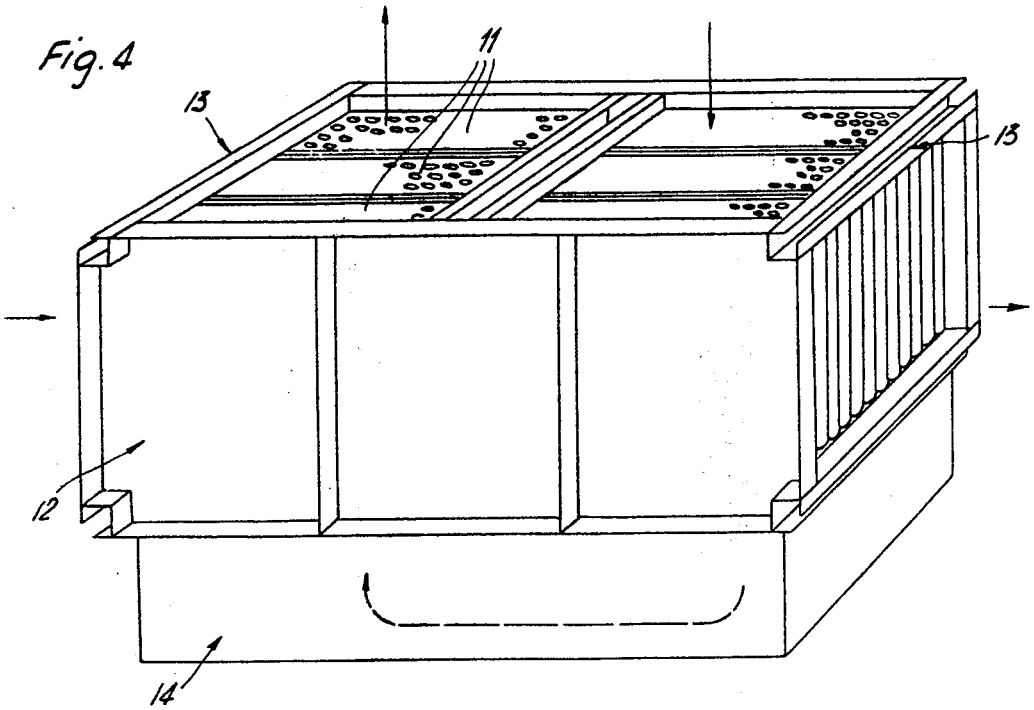
FIG. 4 is a diagram of an example of a tubular heat exchanger with six tube nests.
Figure 5:
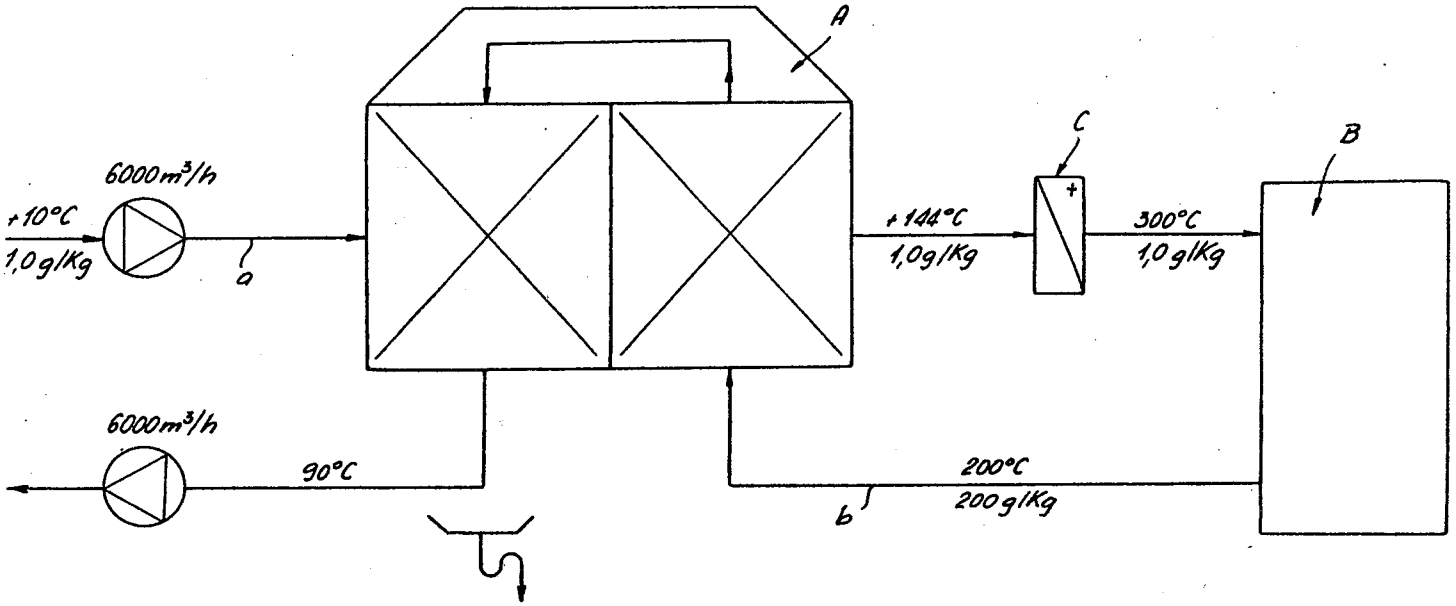
FIG. 5 illustrates the operational diagram of a heat exchanger as in FIG. 4.

The number of tube layers in a unit will generally be less than the number of tubes in each layer. The number and the length of the tubes are so selected that the smallest practicable heat exchanger comprising a single unit 11 is produced. Thus, practically any size heat exchanger can be made by joining a plurality of such units 11 together. FIG. 4 shows an example of such a heat exchanger. Two exchanger blocks, each consisting of three units 11 are combined together to build the tube exchanger of FIG. 4. Assembly of the units takes place by tightly connecting the units adjoining the abutting shaped bars 3. The exchanger blocks so formed are installed in a housing consisting of transverse shaped bars 13 which connect sidewalls 12 and a reversing hood 14. This permits a cross-counterflow operation of the heat exchanger, as indicated by the arrows in FIG. 4. The illustrative plant diagram of such a heat exchanger as shown in FIG. 4 is applied in FIG. 5 in an air-drying facility. The applied air moves through the flow path formed between the heat exchanger tubes where it is preheated by the exhaust air from dryer B moving in counterflow through the tubes of both exchanger blocks. The supply of air so preheated is raised in the adjoining heating system C to the desired operational temperature before reaching dryer B which it leaves as still warm exhaust air flowing through the heat exchanger tubes. The values for temperature and humidity content listed in FIG. 5 shows that very appreciable savings in energy are feasible with a pair of heat exchangers of the kind described. If for instance, a tubular heat exchanger of the described type and following characteristics is used in a drying facility as characterized below, then the heat exchanger will raise the temperature of the cold outside air from 10° to 88.4° C., this energy being removed from the exhaust air flow which, because of expansion into the atmosphere, will cool from 150° to 71.6° C. in the exchanger.

| Heat Exchanger Characteristics: | |
|---|---|
| Height × length × width (mm) | 800 × 1700 × 500 |
| Exchanger surface material | glass tubes |
| Length × diameter (mm) | 720 × 11.5/12.7 ϕ |
| Number of tubes | 1,886 |
| Effective exchange surface ($m^2$) | 50.18 |
| Efficiency (%) | 56 |

| Drying Facility Operational Characteristics | |
|---|---|
| Outside air rate | 3,200 $m^3$/hr |
| Exhaust air rate | 3,200 $m^3$/hr |
| Average outside air temperature | 10° C |
| Exhaust air temperature | 150° C |
| Humidity content in exhaust air | 40 gm/kg |
| Supply air raised to | 190° C |

The economics of this glass tube heat exchanger only requires raising the temperature of the supply air from 88.4° to 190° C. compared to a facility without a heat exchanger. This represents a savings in line output and effective operating costs for air heating of 43.5%.

The described fabrication process permits the employment of glass tubes because the mechanical stresses applied to them both during assembly, when there exists only a slight compression into the viscous material and during operation, when the tubes are elastically held by viscous material, do not reach inadmissible limits. Tubes made from industrial silicates such as glass and which are fastened in a substance completely elastic and of an adhesive nature permit high media transfer rates along the exchange surfaces and hence a large amount of heat transfer because they possess smooth and fine surfaces and furthermore are extremely corrosion resistant and thus not susceptible to deposits. They may be readily used in a temperature range from about −40° to +300° C., the thermal expansions occurring at high temperatures easily being absorbed in a satisfactory manner by the elastic material enclosing the tubes on all sides.

Figure 6:
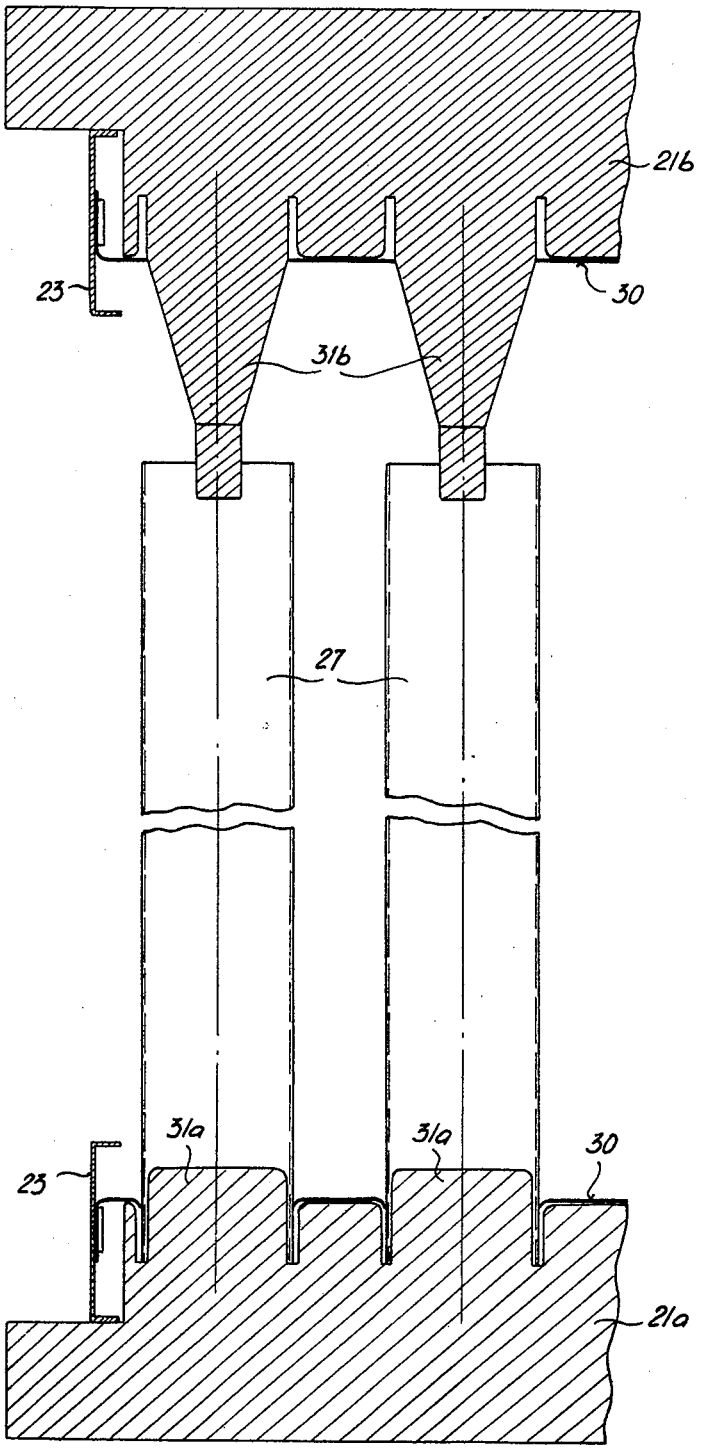
FIGS. 6–8 represent separate phases of a second example of the manufacturing process.
Figure 7:
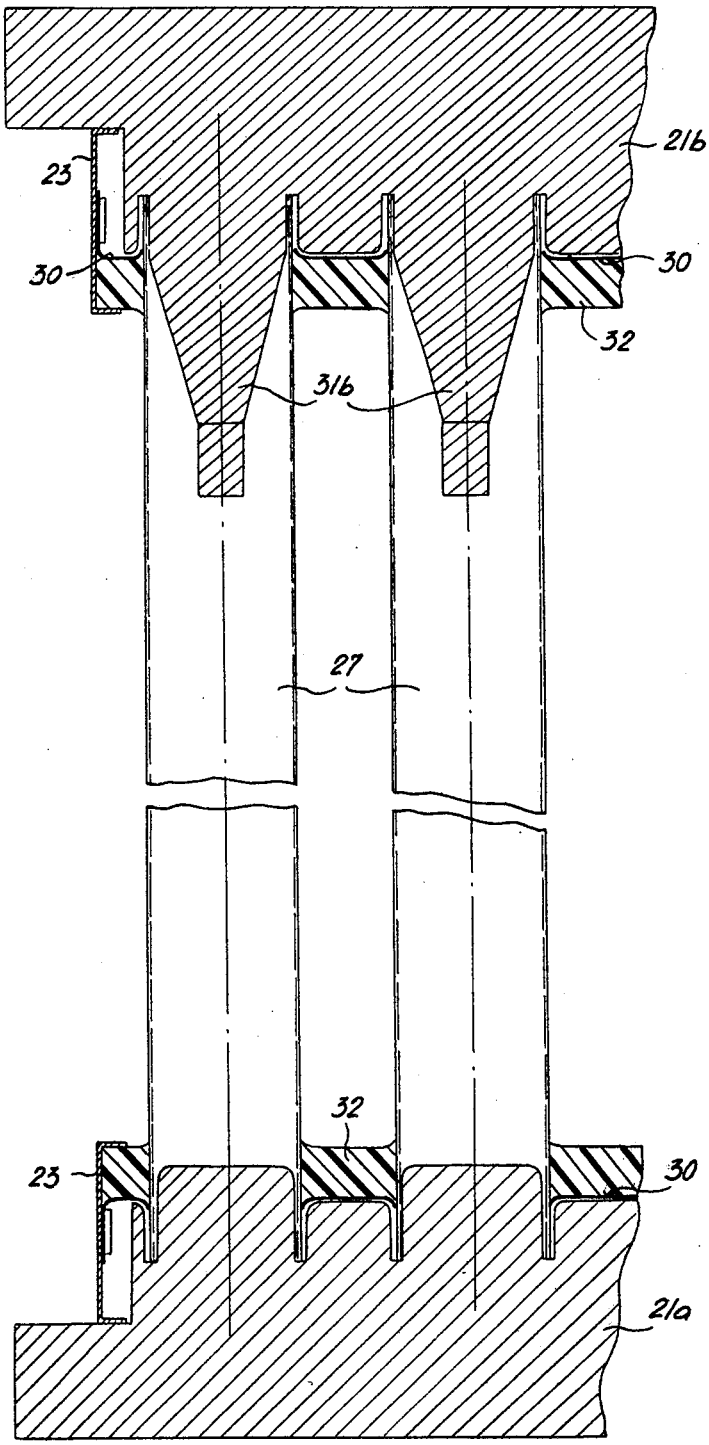
Figure 8:
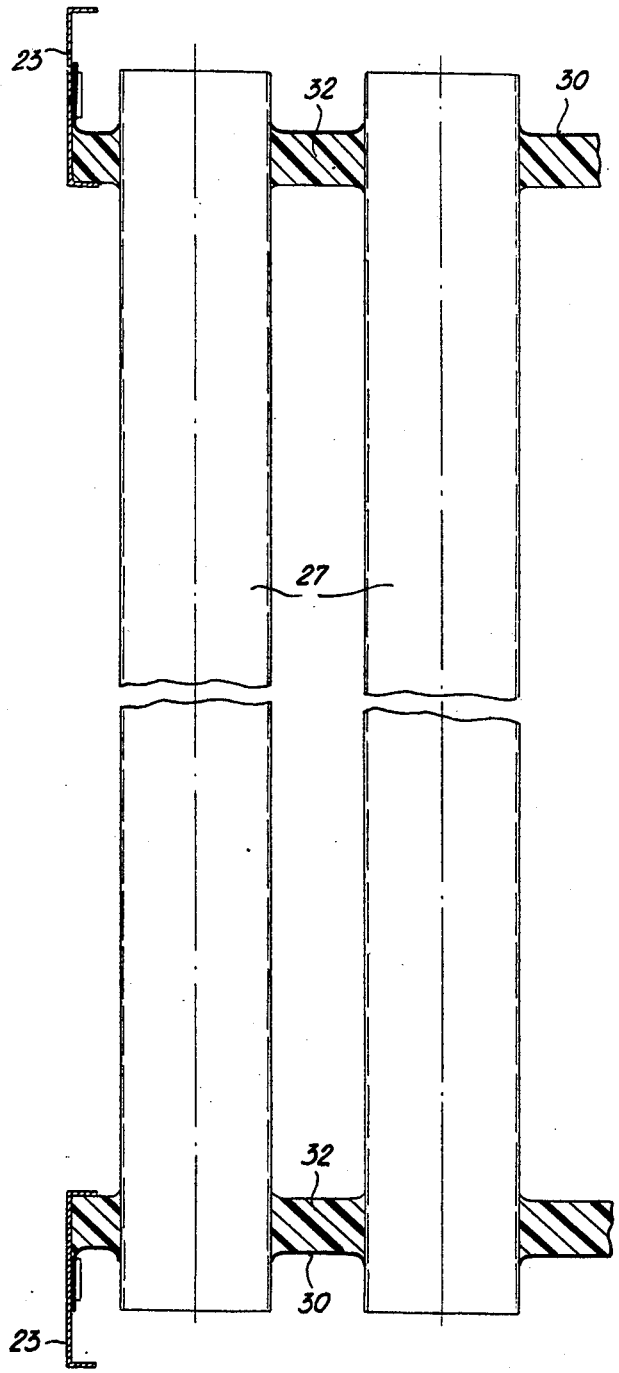

Regarding the process shown in FIGS. 6–8, two templates 21*a* and 21*b* are used for temporarily propping up tubes 27. Frame 23 is placed on horizontal template 21*a*. A plastic foil 30, e.g., teflon, is mounted to said frame, said foil being provided with a number of holes corresponding to the tube carrier pins 31*a* of template 21*a* through which the tubes 27 are engaged in an upright position on pins 31*a* of said template. To fasten tubes 27, upper template 21*b* is lowered on the upper ends of the tubes. Template 21*b* is also provided with a frame 23 bearing a foil 30. In order to facilitate penetration of pins 31*b* of template 21*b*, they are conically tapered. As shown by FIG. 7, the lower shell formed by frame 21*a* and by foil 30 which has been pierced by the tubes is first potted with a liquid plastic, for example, silicone rubber. After hardening, this material will form an elastic wall 32 tightly adhering to tubes 27 and covered with respect to the outside by foil 30. When the whole unit is turned upside down, i.e., rotated by 180° in the vertical direction, the second wall 32 is poured and hardened in the vicinity of frame 23 mounted to template plate 21*b*. Templates 21*a* and 21*b* will then be removed so that a stable heat exchanger unit may be mounted alone or combined with other like units in an exchanger housing.

Figure 9:
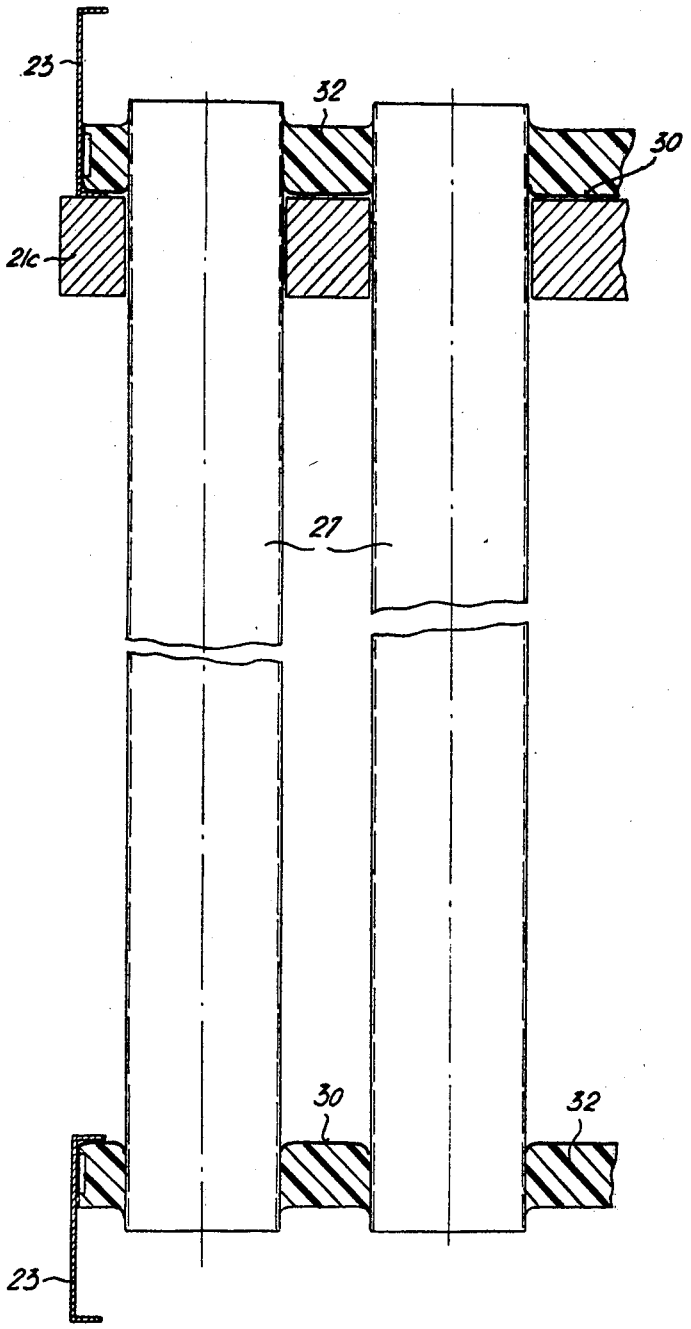
FIG. 9 is a section showing a variation in the heat exchanger unit of FIG. 8.

It should be understood that the same process may also be carried out in the absence of an elastic foil 30 covering wall 32 if sealing of the potting shell or pan bounded by frame 23 is provided in another manner. This assumes, however, that solid adhesion of the potting can to the template can be prevented by suitable treatment. Again, one may provide foil 30 as an inside cover for wall 32 made by potting, as illustrated in the variation of FIG. 9. It is also understood that in this case the template serving as its bottom of the potting can must be designed as a hole-template traversed by the tube ends, as shown at 21*c* in FIG. 9.

Figure 10:
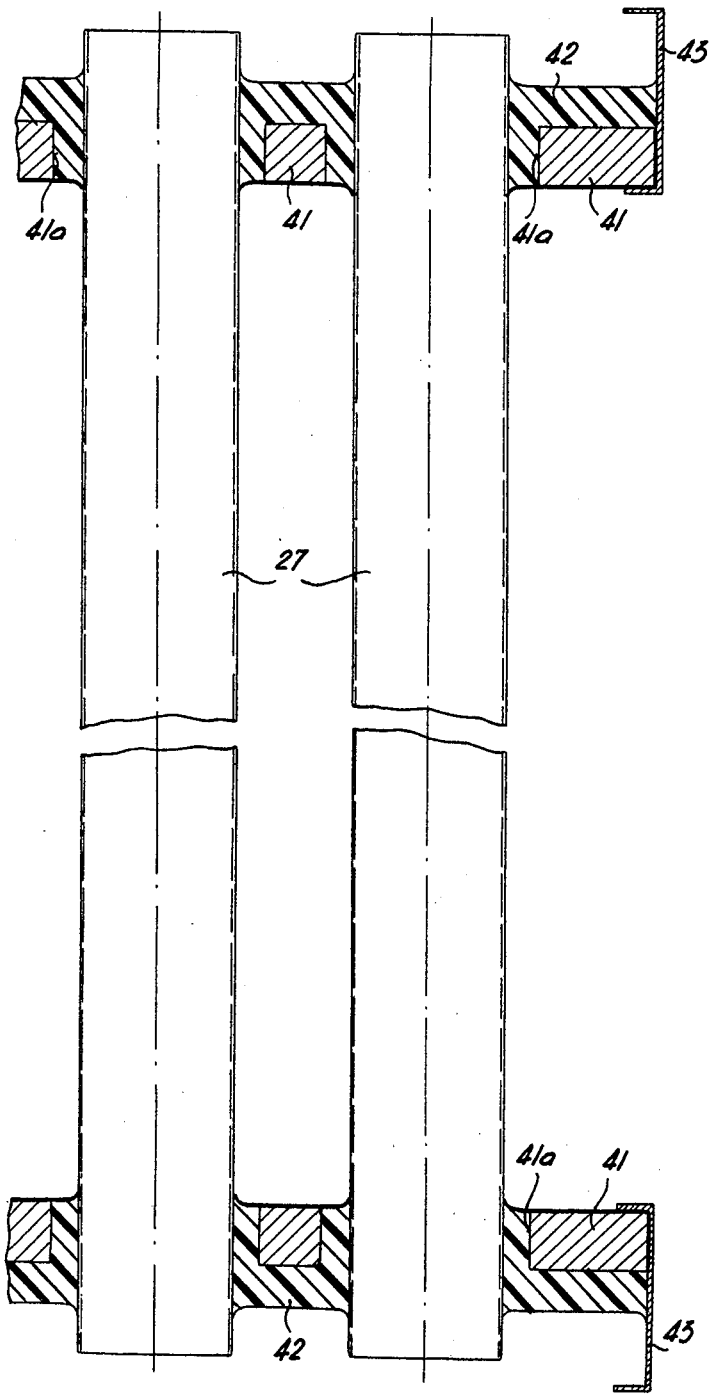
FIG. 10 is a further variation of the heat exchanger unit similar to FIG. 9.

The embodiment of the heat exchanger of the present invention shown in FIG. 10 was found to be particularly appropriate, both with respect to manufacture and to application. A hole-plate or foil 41 placed in frame 43 is used in this embodiment as the potting form. The upright, supported tubes 27 pass with their upper ends through the openings 41*a*, which are somewhat larger than the tube diameters of the hole-template 41. As potting proceeds, the material distributes itself evenly through capillary action into the interstices between the hole bore and the tube. The material viscosity is so adjusted with respect to the size of the interstices that virtually no material leaks out in the downward direction. The capillary action utilized to fill the interstices effects centering of the tubes in plate hole 41 and ensures that each tube 27 is surrounded along its entire circumference by material of constant annular thickness. Simultaneously, the material hardening above hole-plate 41 into a cohesive and elastic wall 42 ensures that enough length of the tube adheres to the plastic so that a solid and tight connection between wall and tube is achieved. By turning over the tube structure by 180° and pouring the other wall in a similar manner, the heat exchanger is completed. It is understood that partitions may be fabricated in a similar manner.

Again it is possible in this example to cover the outside of wall 42 or the inside of hole-plate 41 or the material forming the interstice seal by a protective foil.

In order to obtain flawless capillary action when potting for the purpose of filling the hole-plate interstices, it has been determined that viscosities of about 300–400 p and tube diameters of 13 mm require hole diameters in the hole-plate of about 0.1 to 0.5 mm larger than the tube diameter. This also takes care of conventional glass tube tolerances of about ±0.15 mm.

Besides the flawless tight and adhesive connection between the elastic wall and the industrial silicate tubes, the heat exchanger of the present invention holds an essential advantage in its simple method of manufacture which places little stress on the ordinarily thin-walled, breakage-prone tubes. The hole-plate or foil increases the strength of the wall, the need for the relatively expensive potting compound is small, and costly profile gauges are eliminated.

Borosilicates may be used as tube materials for operating temperatures of up to about 250° C. Exchangers operating at large temperature differences may also use quartz glass.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A tubular heat exchanger comprising a plurality of heat exchange tubes placed in a stacked, spaced-apart relationship and disposed substantially parallel to each other in the vertical and horizontal direction, each of the opposing end portions of said plurality of tubes being adheringly embedded in a wall of a hardened, elastic material, disposed transverse to the longitudinal direction of said tubes, said wall at both end portions of said tubes sealably separating an inner zone defined by the space around said tubes from the end zones which communicate with the space within said tubes, metal profile bars sealably adhering to the wall of the elastic material at the uppermost and lowermost sides of said stack and at both opposing end portions of said tubes, said plurality of stacked tubes being disposed on a base plate, said base plate containing a plurality of spacer elements which extend substantially vertically from said base plate for providing horizontal separation between adjacent rows of heat exchanger tubes and additional spacer elements disposed transverse to the longitudinal direction of the heat exchanger tubes for providing vertical separation between adjacent rows of heat exchanger tubes, said tubular heat exchanger being adapted to handle a first medium through the tubes themselves via said end zones and a second medium which flows around said tubes, transverse to said tubes through said inner zone.

2. The tubular heat-exchange unit of claim 1, wherein a plurality of said units are mounted in a common housing.

3. The tubular heat-exchange unit of claim 1, wherein the elastic material is silicone rubber.

4. The tubular heat-exchange unit of claim 1, wherein the walls of hardened elastic material are covered on at least one side thereof with a plate or foil which is penetrated by said tubes, said plate or foil being adhesively connected with said wall.

5. The heat exchange unit of claim 4, wherein the plate is a metal plate containing a number of holes which correspond with the number of heat-exchange tubes, said heat-exchange tubes extending through said holes with the interstices disposed between the tubes and said holes being filled with the elastic material forming said walls.

6. The tubular heat-exchange unit of claim 4, wherein the foil is a plastic material.

7. The tubular heat-exchange unit of claim 6, wherein the plastic material is Teflon.

* * * * *

UNITED STATES PATENT AND TRADEMARK OFFICE

CERTIFICATE OF CORRECTION

PATENT NO. : 4,117,884

DATED : October 3, 1978

INVENTOR(S) : Willi Frei

It is certified that error appears in the above-identified patent and that said Letters Patent are hereby corrected as shown below:

Under the heading [30] Foreign Application Priority Data, please delete the listing of priority applications and substitute therefor the following:

--Mar. 21, 1975 [CH] Switzerland ..... 3631/75
Feb. 5, 1976 [CH] Switzerland ..... 1390/76--

Signed and Sealed this

Sixth Day of March 1979

[SEAL]

*Attest:*

RUTH C. MASON
*Attesting Officer*

DONALD W. BANNER
*Commissioner of Patents and Trademarks*